United States Patent [19]

Lorenz

[11] 4,070,941

[45] Jan. 31, 1978

[54] SLICING MACHINE

[75] Inventor: Horst Lorenz, Solingen, Germany

[73] Assignee: Firma Robert Krups, Solingen, Germany

[21] Appl. No.: 711,874

[22] Filed: Aug. 5, 1976

[30] Foreign Application Priority Data

Apr. 13, 1976 Germany ..... 7611681[U]

[51] Int. Cl.[2] ..... B26D 4/04; B26D 4/20

[52] U.S. Cl. ..... 83/478; 83/549; 83/397; 83/701; 83/666

[58] Field of Search ..... 83/544, 478, 473, 397, 83/467 A, 701, 666, 676, 481, 860, 471, 648, 698; 144/285, 286 R

[56] References Cited

U.S. PATENT DOCUMENTS

| | | | |
|---|---|---|---|
| 2,020,216 | 11/1935 | Sarac | 144/285 |
| 2,611,406 | 9/1952 | Preble | 83/701 |
| 2,859,785 | 11/1958 | Stolbach | 83/701 |
| 3,440,915 | 4/1969 | Weyant | 83/666 |
| 3,704,736 | 12/1972 | Pratley | 83/397 |

FOREIGN PATENT DOCUMENTS

| | | | |
|---|---|---|---|
| 2,023,308 | 11/1971 | Germany | 83/544 |
| 1,194,727 | 6/1965 | Germany | 83/478 |

*Primary Examiner*—Donald R. Schran
*Attorney, Agent, or Firm*—Michael J. Striker

[57] ABSTRACT

A slicing machine has a housing on which a blade is rotatable about a horizontal axis. The blade is covered by a cover plate which must be in position in order to allow depression of the push-button which starts the device. In addition, the blade is held to its hub by means of a connecting element that connects screw-fashion to the hub over the blade and which can be removed or tightened by hand. A support plate adjacent the blade can be swung between a down position in which a foodstuff can be slid along it during slicing and an up position out of the way paralllel to the blade. A foot on this support plate can be moved between a projecting position in which it can function as a foot and a flat position recessed in the support plate.

15 Claims, 8 Drawing Figures

SLICING MACHINE

BACKGROUND OF THE INVENTION

The present invention relates to a slicing machine. More particularly this invention concerns an electrically powered home-type slicing machine.

A home slicing machine is known which has a generally circular blade that is rotated by an electric motor about a horizontal axis. The housing of the machine is formed with an arcuate slit from which the blade projects and is provided underneath the blade with a support surface along which a foodstuff to be sliced is slid as slices are cut off it by the blade. These slices then slip down underneath the arrangement onto a plate or the like that receives them.

It is necessary to be able to clean the blade of the apparatus when it is not being used continuously. This requires the removal of the cover plate that overlies most of the blade, leaving only an arcuate portion of its edge exposed, and also frequently requires removal of the blade for a thorough cleaning. With the cover plate removed the entire blade is exposed and the likelihood of accident is increased greatly. Furthermore, the removal of the blade in many devices requires the use of separate tools such as at least a screwdriver so that this necessary cleaning operation is done infrequently due to the complexity of removing the blade.

Another disadvantage of the known home slicers for meat, cheese, and the like is that the support plate underneath the blade along which the foodstuff is slid for slicing incorporates relatively complicated catches and mechanisms that make its cleaning difficult. Such a support plate is normally pivoted on the housing of the slicing machine so that it can be swung up out of the way when the slicing machine is not in use so that it takes up a minimum amount of space. The various pivots are frequently relatively complicated and hard to clean. Furthermore, the support plate usually has a foot that holds it up parallel to the surface on which the machine rests. This foot must pivot between a pair of positions on the outer edge of the support plate and is typically held in place by complicated and exposed catch mechanisms which also are extremely difficult to clean and, due to their exposed condition, failure prone.

SUMMARY OF THE INVENTION

It is therefore an object of the present invention to provide an improved slicing machine.

Another object is the provision of such a machine wherein the blade can easily be removed.

Yet another object is to provide such a machine wherein the possibility of cutting oneself on the blade is considerably reduced.

A further object is to provide an improved support plate for such a slicing machine which is relatively easy to clean and simple in construction.

These objects are attained according to the present invention in a slicing machine having a housing, a blade rotatable on the housing about a generally horizontal axis, drive means including an electric motor in the housing for rotating this blade about this axis, means including a start element actuatable for operating the drive means, a cover plate pivotal on the housing between a closed position covering most of the blade and an open position exposing the blade, and means including a link engageable with the blade and with the start element for preventing actuation of the start element except when the plate is in the closed position. In addition this slicing machine is provided with a support plate pivotal on the housing adjacent the blade between an upper position closely juxtaposed with the side of the housing and a down position where it forms a sliding surface for a foodstuff to be sliced.

Thus with the slicing machine according to the present invention once the blade cover plate is removed it is impossible for the drive to be actuated. This cover plate according to the invention has at its lower edge a pair of tabs of engaging corresponding holes and recesses in the housing and at its upper end a laterally projecting finger that engages through a hole in the housing with the link that blocks the actuating element. Biasing means in the form of a spring urge the link into a position underlying the starter element or pushbutton for the on-off switch of the apparatus so that when the laterally extending finger on the upper edge of the blade cover plate is not engaged in the recess this link underlies the starter button and prevents it from being depressed. The link according to this invention is formed as an annular, here square or rectangular, body that engages around the pushbutton so that only when this body is perfectly aligned under the pushbutton after depression by the laterally projecting finger on the cover plate can the pushbutton be depressed.

According to another feature of this invention the blade is secured on the housing on a support hub made of synthetic-resin material and formed with an annular recess centered on the rotation axis for the blade. This hub is formed with a plurality of small projections angularly equispaced about the axis and adapted to engage through corresponding holes in the metallic blade in order to rotationally link the two. In the recess the hub is formed with a plurality of angularly equispaced engaging or locking formations each having a surface turned away from the open side of the recess which is inclined to an imaginary plane perpendicular to the rotation axis. The blade is locked to this hub by means of a connecting element formed again as synthetic resin material and having an annular collar on which is formed a plurality of angularly equispaced engaging formation that has surfaces turned away from the hub which are inclined to an imaginary plane perpendicular to the axis of the connecting element. Thus, these two elements can be fitted together and rotated relative to each other so that the engaging formations lock tightly against each other. To this end the connecting element is formed with a laterally connecting flange that serves to clamp the blade to the face of the hub. Inside this flange the connecting element is recessed and is formed with transversely extending ribs that allow it to be easily gripped by the hand of the user for rotation and, therefore, freeing of the blade from the drive hub.

In accordance with yet another feature of this invention the support plate is provided with a foot having an edge that is pivoted on the support plate by means of two pins and an opposite edge formed with a finger-receiving groove. Each of the pins is formed with a plurality of flats, preferably four angularly equispaced flats that are engaged by a spring carried in a recess in the support plate. Each of these recesses is covered over so that the spring, which therefore can define a plurality of 90°offset positions for the foot, is completely encased and presents no cleaning problem. The spring has a central finger and two side fingers, the central finger bears resiliently against the flatted portion of the pivot and the two side fingers bear against the cylindrical portions flanking this flatted portion. In addition the spring is formed at its end turned away from the pivot with a pair of grooves that interfit with corresponding ridges or formations on the support plate so that this spring is held securely in place. Thus, the foot can readily be swung from a position parallel to and even recessed in the support plate to a position perpendicular thereto, whereas the mechanism that locks it in each of these positions is relatively simple and presents no outside surfaces that need cleaning.

According to another feature of this invention the support plate is pivoted at its edge opposite the foot on the housing by means of two pins projecting coaxially parallel to this edge. The housing is provided with pair of journals for these pins, one of the journals is, however, formed as a slot which can be opened and closed so as to allow the support plate to be removed from the housing. This slot is closed in accordance with this invention by means of a sleeve having a radially opening aperture so that when the aperture is aligned with the slot the respective pin can be pulled out of the sleeve, but when not aligned with the slot it locks it in place for standard journal-type pivoting action.

The novel features which are considered as characteristic for the invention are set forth in particular in the appended claims. The invention itself, however, both as to its construction and its method of operation, together with additional objects and advantages thereof will be best understood from the following description of a specific embodiment when read in connection with the accompanying drawings.

SPECIFIC DESCRIPTION OF A PREFERRED EMBODIMENT

Figure 1:
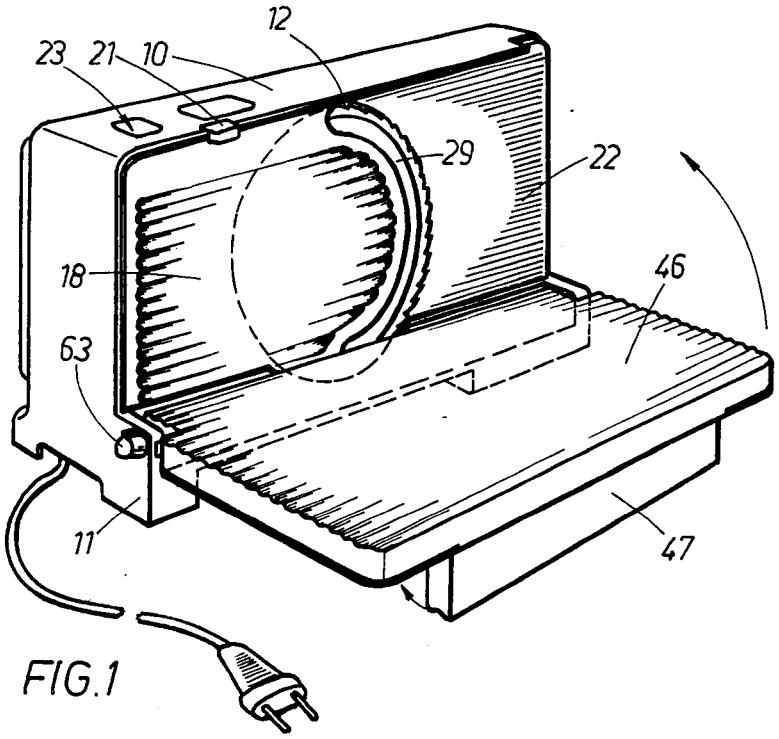
FIG. 1 is a perspective view of the slicing machine according to the present invention in ready-to-use condition.
Figure 2:
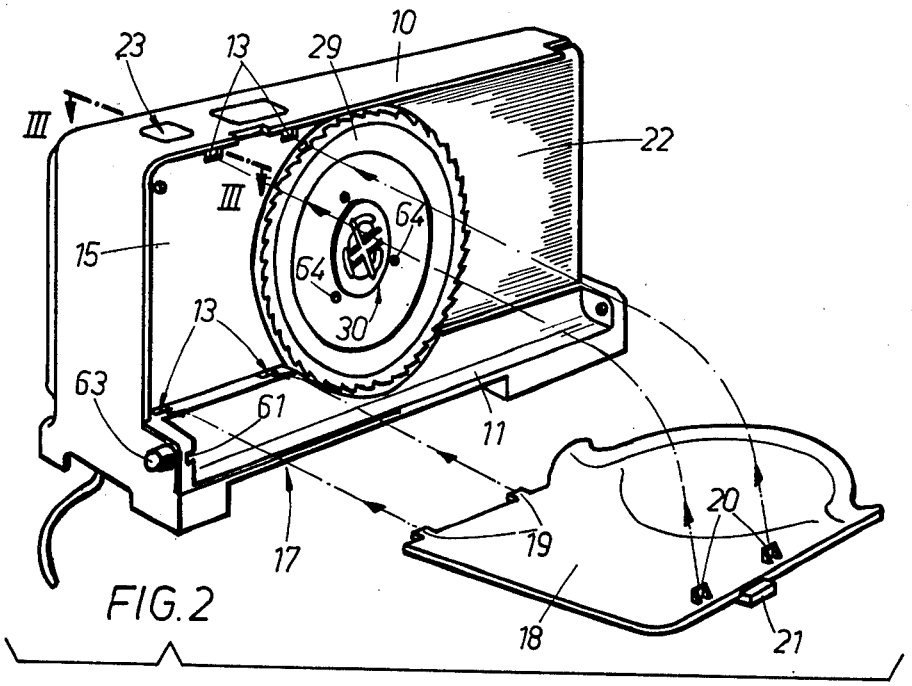
FIG. 2 is a perspective view of the slicing machine with the support plate and cover plate removed.

As shown in FIGS. 1 and 2, the slicing machine according to the present invention has a housing 10 adapted to stand via feet 11 on a flat surface. This housing 10 is formed with an arcuate opening 12 that exposes an annular steel blade 29. This opening 12 is defined in part by a cover plate 18 having at its lower edge tabs 19 adapted to engage in recesses 13 on the housing over a portion 15 thereof. In addition, at its upper edge this plate 18 has a lug 21 to engage in a corresponding notch on the housing so as to center the plate 18 and allow its easy removal. Laterally extending tabs 20 on the housing flanking the lug 21 are engageable in further recesses 13 on the wall 15 of the housing. One of these last-mentioned recesses 13 being aligned with a push-button on-off switch 23

In use a support plate 46 is supported on the support surface by means of a foot 47 and a piece of meat, cheese, or the like to be sliced is slid along this plate 46 against a face 22 of the apparatus so that a slice is cut off by the rotating blade 29. Underneath the housing 10 there is formed an empty space 17 in which a plate can be positioned so that the slices cut off by the blade 29 can drop onto this plate.

Figure 3:
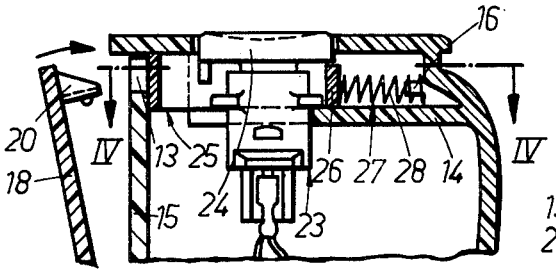
FIG. 3 is a section taken along line III—III of FIG. 2.
Figure 4:
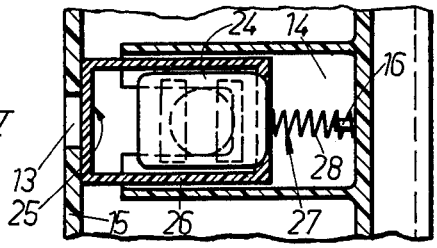
FIG. 4 is a section taken along line IV—IV of FIG. 3.

As mentioned above, and as best shown in FIGS. 3 and 4, the cover plate 18 has fingers 20 which are engageable through recesses one of which is aligned with the switch 23. The switch 23 has a push-button 24 of square shape that is alignable with the central opening of a link 25 constituted by a square frame member 26 that is slidable in a pocket 14 in the housing 10 toward and away from the respective hole 13. Biasing means 27 in the form of a spring 28 is braced between a pin 16 on the housing and the one end of the link member 26 so as to urge this member into the position shown in FIG. 3 where it underlies the push-button 24 and prevents its depression. Thus, unless the respective finger 20 engages through the respective hole 13 with the link 25 it is impossible for the push-button 24 to be depressed so that the user cannot inadvertently start the blade 29 rotating when the cover plate 18 is removed.

Figure 5:
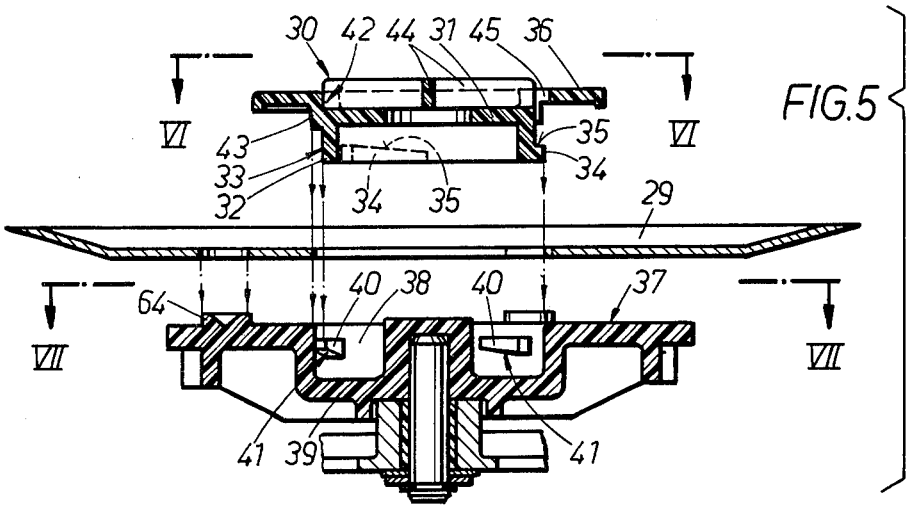
FIG. 5 is an axial section through the blade assembly in exploded condition.
Figure 7:
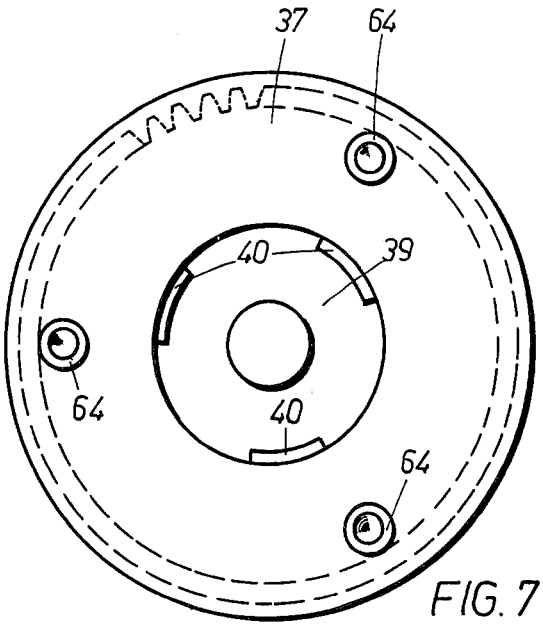
FIGS. 6 and 7 are views taken in the direction of lines VI—VI and VII—VII of FIG. 5.
Figure 6:
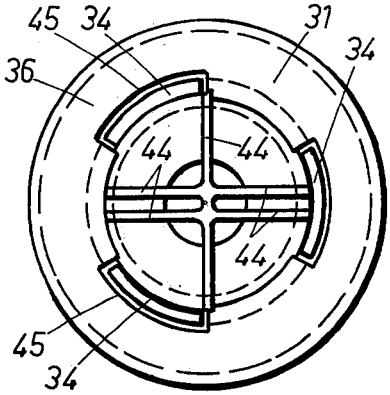

As shown in FIGS. 5 - 7 the metallic blade 29 is secured to a hub 37 constituting the output element of the drive means that is itself rotated by means of a pinion engaging peripheral teeth on the element 37 by means of a connecting element or screw connector 30. The element 37 is formed with an annular recess 38 centered on the rotation axis for the blade 29 and provided internally with three circularly arcuate engaging formations 40 having surfaces 41 turned away from the element 30 and inclined to an imaginary plane perpendicular to the rotation axis of the element 37. This recess 38 is defined by a base 39 so that pieces of the foodstuff being sliced cannot work their way into the mechanism. In addition the hub 37 is formed with three angularly equispaced projections or engaging formations 64 that can engage the correspondingly shaped and positioned holes in the blade 29 in order rotationally to link the blade 29 to the hub 37.

The connecting element 30 is formed with a cylindrical collar 32 from whose outer surface 33 project three engaging formations or teeth 34 having upper surfaces 35 again inclined to an imaginary plane perpendicular to the axis of the element 30 so as to be tightly engageable under the surfaces 41. The element 30 is recessed at the collar 32 and has a transverse wall 31 and outward of this wall 31 a flange 36 adapted to press the blade 29 against the corresponding flat surface of the hub 37. Furthermore, the element 30 is formed with a step 43 that exactly fits the internal hole in the blade 29 so as to exactly center this blade 29. Ribs 44 on the recess 42 formed in the face of the element 30 make it easy to rotate the element 30 by hand, and cutouts or apertures 45 in line with the teeth 34 make it very easy to see that proper position of the device and control exactly how tight it is.

Thus it is possible by hand after removing cover plate 18 to unscrew the element 30 and lift off the blade 29. No tools are needed so that this operation can be carried out with great ease, therefore making cleaning the blade a relatively easy operation.

The plate 46 as described above and as shown in detail in FIG. 8 is hinged via pins 62 on the housing 10. These pins 62 engage in corresponding journals 61 in the housing 10. One of the journals 61 is formed as a slot that can be closed by means of a rotatable sleeve 63 so as to allow the slot to be closed and the element to be locked in place. Thus, the plate 46 can be completely removed simply by aligning the gap in the sleeve 63 with the slot 61 and pulling the corresponding pivot pin 62 away from the housing 10.

Figure 8:
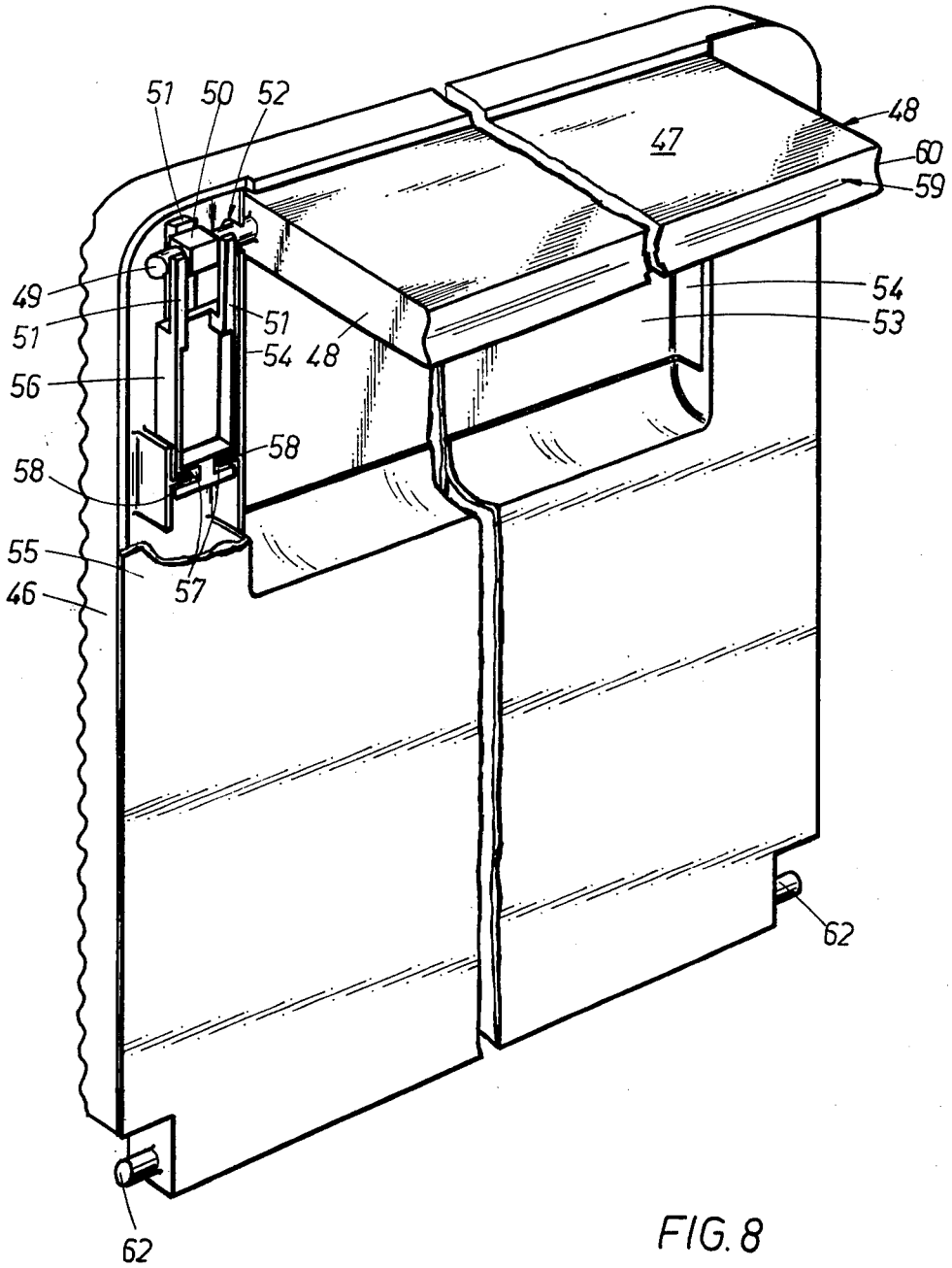
FIG. 8 is a perspective view partly broken away illustrating the bottom side of the support plate in accordance with the present invention.

The foot 47 as shown in FIG. 8 has a pair of edges 48 from which extend pivot pins 49. In addition the lower edge 59 of these elements 46 is formed with a groove 60 that facilitates grabbing it and pulling it out of a recess 53 formed in the bottom of the plate 46.

Each of the pins 49 is provided with a central generally cubical or flatted element 50 that is pressed against by one finger 51 of the spring 56 whose two other fingers 51 ride on the cylindrical smooth portions of the pins 49. Each of these pins 49 passes through a notch 52 in a side wall 54 of the blade 46 into a recess in the plate 46 which is closed by a cover plate 55. In addition a pair of oppositely open grooves or slots lying in a plane parallel to the axis of the pins 49 and perpendicular to the spring 52 receive ridges or tabs 58 formed on the plate 46 so that the spring 56 is held relatively snugly in place in the plate 46.

This particular arrangement for defining a plurality of 90° offset positions for the foot 47 makes it very easy to move it between the erect position in which it can be used as a foot on which the plate 46 stands and another position received in the recess 53 so as to be completely out of the way. The mechanism that defines these positions is relatively simple and is completely enclosed so that it need not be cleaned.

The slicing machine according to the present invention can therefore be relatively easily cleaned and taken apart. At the same time when the blade is exposed by removal of its cover plate it is impossible to start the apparatus so that the likelihood of cutting one self or cleaning it is ruled out. In addition it is possible to flap up the support plate and the foot thereon so that when not in use the device takes up very little space.

It will be understood that each of the elements described above, or two or more together, may also find a useful applicaton in other types of structure differing from the types described above.

While the invention has been illustrated and described as embodied in a slicing machine, it is not intended to be limited to the details shown since various modifications and structural changes may be made without departing in any way from the spirit of the present invention.

Without further analysis, the foregoing will so fully reveal the gist of the present invention that others can by applying current knowledge readily adapt if for various applications without omitting features that, from the standpoint of prior art, fairly constitute essential characteristics of the generic or specific aspects of this invention.

What is claimed as new and desired to be protected by Letters Patent is set forth in the appended claims.

1. A slicing machine comprising:

a housing;

a blade rotatable on said housing about a generally horizontal axis;

drive means in said housing for rotating said blade about said axis;

means connected to said drive means including a start element displaceable between an on position for operating said drive means and an off position in which said drive means is inoperative;

a cover plate movable on and relative to said housing independently of said start element between a closed position closely juxtaposed with said housing and covering most of said blade and an open position spaced from said housing and exposing said blade; and means including a link engageable with said plate and with said start element for preventing displacement of said start element from said off position into said on position except when said plate is in said closed position.

2. The machine defined in claim 1 wherein said housing is formed with upwardly open recesses and said cover plate is formed with tabs receivable in said recesses and with lateral projections engageable with said link in said closed position only, whereby said cover plate is pivoted on said housing, said blade being fully exposed and removable in said open position of said cover plate.

3. The machine defined in claim 1 wherein said starting element is a depressable button and said link is slidable between a locking position preventing depression of said button and a freeing position allowing depression of said button, said means for preventing including means for biasing said link into said locking position.

4. The machine defined in claim 3 wherein said means for preventing is provided in said housing which is formed there adjacent with a throughgoing hole, said cover plate being provided with an operating finger engageable through said hole with said link for displacing same into said freeing position in said closed position of said cover plate.

5. The machine defined in claim 4 wherein the biasing means is a spring braced between said link and said housing.

6. The machine defined in claim 1 wherein said drive means includes a mounting plate rotatable about said axis and formed with a socket having a plurality of angilarly spaced engaging formations inclined to an imaginary plane perpendicular to said axis, and a connecting element formed with a projection engageable in said socket and having respective engaging formations engageable with the first mentioned formations to clamp said blade between said mounting plate and said connecting element, said connecting element being rotatable about said axis relative to said mounting plate through substantially less than one complete revolution between a holding position wherein said blade is clamped to said plate and said engaging formations bear axially on one another and a releasing position with said engaging formations axially out of alignment and engagement with each other and said connecting element axially removable from said mounting plate.

7. The machine defined in claim 6 wherein said projection is cylindrical and is provided with three such formations each engageable with a respective such formation on said mounting plate.

8. The machine defined in claim 7 wherein said connecting element has a lateral flange and is recessed centrally beneath this flange and is centrally formed with a transverse rib.

9. The machine defined in claim 8 wherein said flange of said connecting element projects inwardly above the respective formations.

10. The machine defined in claim 1, further comprising a support plate pivotal on said housing adjacent said blade and provided with a foot having a pair of pivot pins journaled in said support plate and each formed with at least two flats, angularly offset by generally 90° , said support plate carrying a spring engageable with said flats for defining a pair of stable positions for said foot.

11. The machine defined in claim 10 wherein said support plate is formed with two recesses each receiving a respective pivot pin and said support plate is provided with a cover for said recesses.

12. The machine defined in claim 11 wherein each of said springs has a central spring finger bearing against the respective flats and a pair of fingers flanking said central finger and bearing against the respective pin to each side of said flats.

13. The machine defined in claim 12 wherein each of said springs has a groove extending transverse to said fingers and said support plate is formed at each of said recesses with formations engaging in said grooves.

14. The machine defined in claim 10 wherein said foot is formed at its edge remote from said pins with a groove.

15. The slicing machine defined in claim 1 wherein said drive means includes means releasably holding said blade, said blade being fully exposed and removable only in said open position of said cover plate.

* * * * *